US008033866B2

(12) United States Patent
Mao et al.

(10) Patent No.: US 8,033,866 B2
(45) Date of Patent: Oct. 11, 2011

(54) RECEPTACLE CONNECTOR HAVING REINFORCED BRACKET INCREASING OVERALL RIGIDITY

(75) Inventors: Yu-Hua Mao, Kunshan (CN); Zhi-Hong Fang, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/578,523

(22) Filed: Oct. 13, 2009

(65) Prior Publication Data

US 2010/0093221 A1 Apr. 15, 2010

(30) Foreign Application Priority Data

Oct. 14, 2008 (CN) ..... 2008 2 0186174

(51) Int. Cl.
*H01R 25/00* (2006.01)

(52) U.S. Cl. ..... 439/638

(58) Field of Classification Search ..... 439/638, 439/660, 607.01, 607.27, 607.35, 567, 569, 439/79

See application file for complete search history.

(56) References Cited

U.S. PATENT DOCUMENTS

| | | | | |
|---|---|---|---|---|
| 6,109,966 | A * | 8/2000 | Chiou | 439/607.03 |
| 6,666,694 | B1 * | 12/2003 | Daly et al. | 439/79 |
| 6,755,691 | B2 | 6/2004 | Sasame et al. | |
| 6,939,177 | B2 | 9/2005 | Kato et al. | |
| 7,625,245 | B1 * | 12/2009 | Yao | 439/660 |
| 2005/0075010 | A1 * | 4/2005 | Yang et al. | 439/607 |
| 2009/0011623 | A1 | 1/2009 | Hisamatsu et al. | |

FOREIGN PATENT DOCUMENTS

CN 200420074219.8 2/2006

* cited by examiner

*Primary Examiner* — Alexander Gilman

(74) *Attorney, Agent, or Firm* — Andrew C. Cheng; Wei Te Chung; Ming Chieh Chang

(57) ABSTRACT

A receptacle connector comprises an insulative housing having a base portion; a plurality of terminals retained in the insulative housing; a shielding shell assembled on the base portion of the insulative housing and defined a mating cavity. A reinforced bracket includes a main portion attached to a bottom of the shielding shell and a pair of mounting portions extending from two ends of the main portion. Therefore, overall rigidity of the receptacle connector may be increased.

10 Claims, 13 Drawing Sheets

RECEPTACLE CONNECTOR HAVING REINFORCED BRACKET INCREASING OVERALL RIGIDITY

BACKGROUND OF THE INVENTION

This application is related to so and so U.S. patent application Ser. No. 12/549,404, filed Aug. 28, 2009, entitled "Multiport Receptacle Connector Having EMI Shell Interlocked To Partitioning Wall To Preventing Warpage", and assigned to the common assignee, and is incorporated herewith for reference.

1. Field of the Invention

The present invention relates to a receptacle connector, and especially to a receptacle connector having reinforced bracket increasing overall rigidity.

2. Description of the Related Art

CN Pat. No. 200420074219.8 issued to Jian et al. on Feb. 1, 2006, discloses a conventional electrical connector includes a housing, a number of contacts retained in the housing and a shell covering the housing with a mating opening. In order to reduce the overall height of the conventional electrical connector along with a Printed Circuit Board (PCB) after the connector is mounted thereon, the PCB defines a cutout at an edge thereof and the conventional electrical connector within the cutout, and the shell has a pair of solder tabs located at opposite ends thereof for soldering on the PCB, so the conventional electrical connector is firmly fixed to the PCB. However, the conventional electrical connector is spanned over the cutout with any supporting thereunder, the mating interface tends to deform during mating and unmating of a plug connector inserted thereto or withdrawn therefrom.

Therefore, an improved receptacle connector is desired to overcome the disadvantages of the related arts.

BRIEF SUMMARY OF THE INVENTION

An object of the present invention is to provide a receptacle connector with improving strength thereof.

In order to achieve above-mentioned object, a receptacle connector comprises an insulative housing having a base portion; a plurality of terminals retained in the insulative housing; a shielding shell assembled on the base portion of the insulative housing and defined a mating cavity. A reinforced bracket includes a main portion attached to a bottom of the shielding shell and a pair of mounting portions extending from two ends of the main portion. Therefore, overall rigidity of the receptacle connector may be increased so as to prevent any unwanted warpage.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
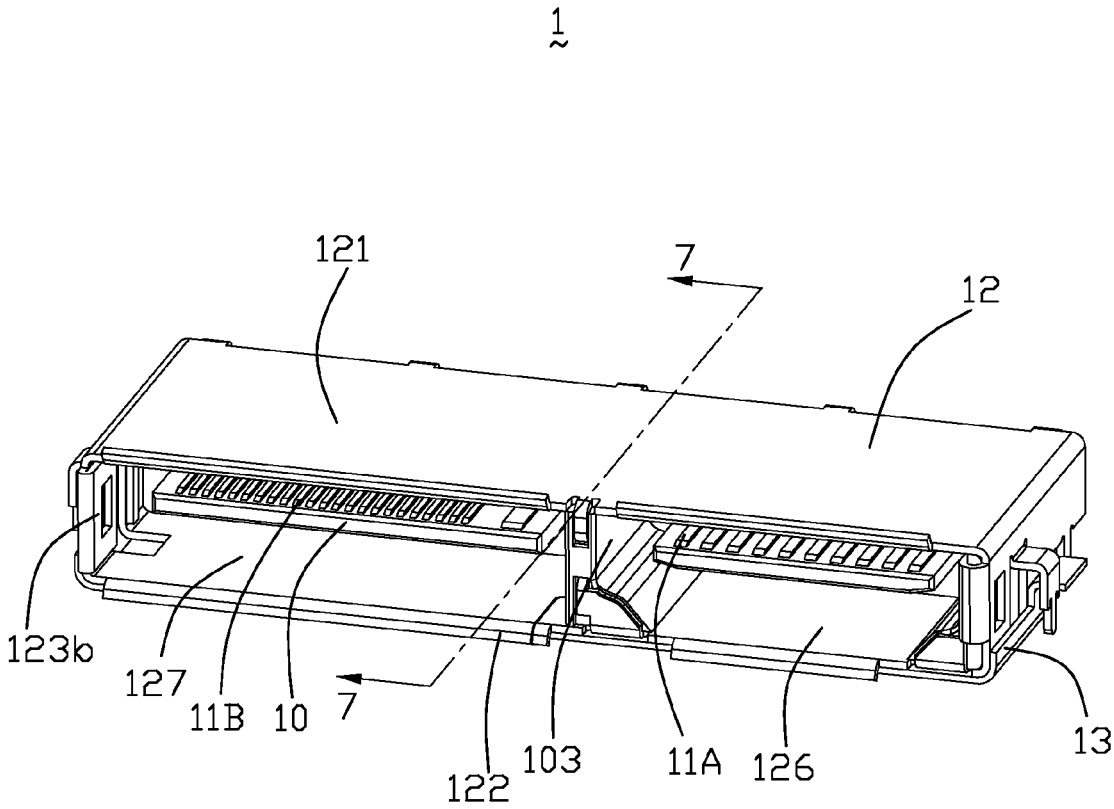
FIG. 1 is a perspective view of a receptacle connector in accordance with a first embodiment of the present invention.

Reference will now be made to the drawing figures to describe the preferred embodiments of the present invention in detail.

Referring to FIG. 1, the receptacle connector 1 made in accordance with a first embodiment of the present invention includes an insulative housing 10, a plurality of first terminals 11A and second terminals 11B retained in the insulative housing 10, a shielding shell 12 covering the insulative housing 10 and a reinforced bracket 13 attached to a bottom of the shielding shell 12, the shielding shell 12 and the reinforced bracket 13 are made of conductive material.

Figure 2:
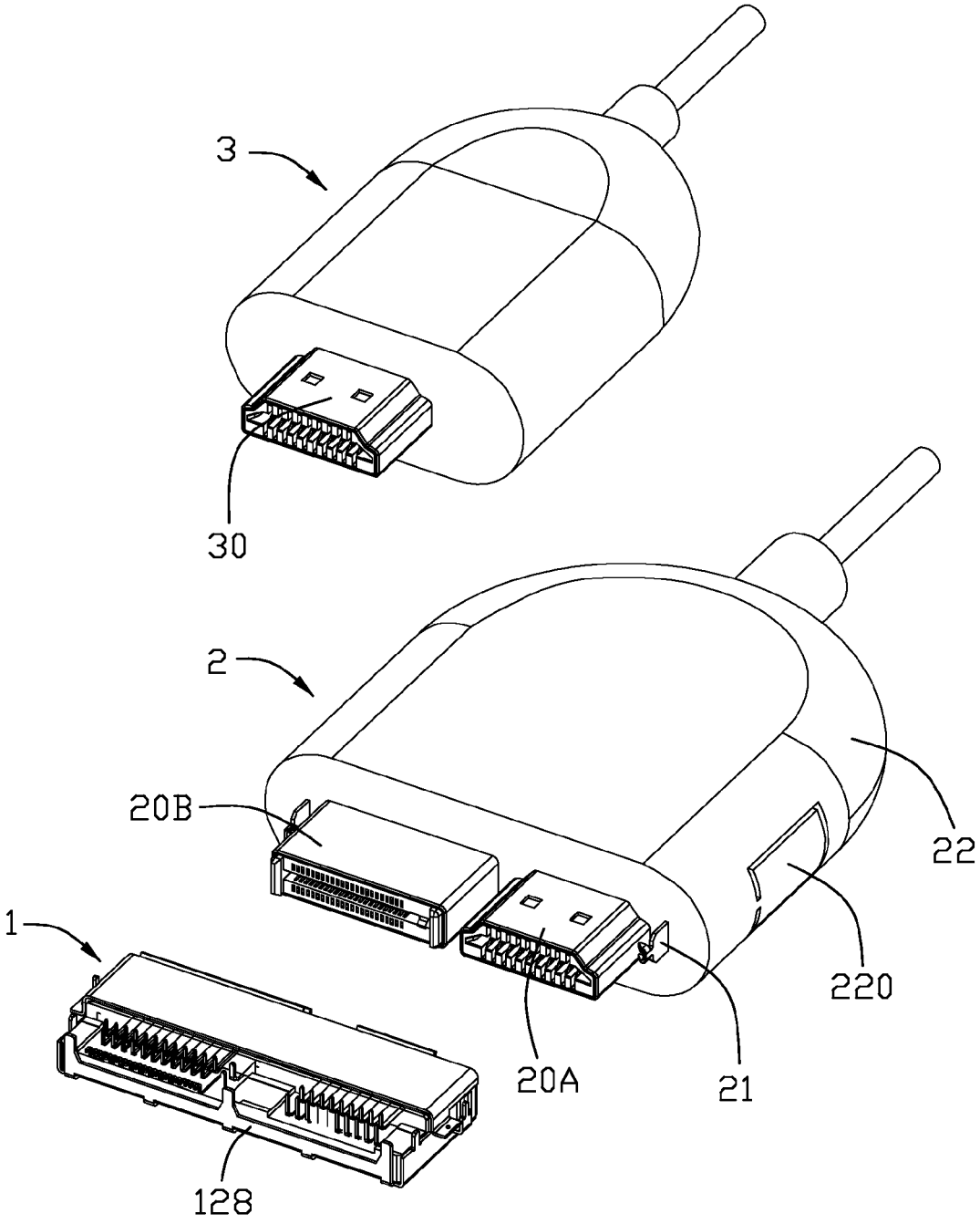
FIG. 2 is another perspective view of FIG. 1 in which the receptacle connector having a pair of interfaces which can alternatively receive a cable connector incorporated a single connector or a cable connector with two different connectors therein are described.
Figure 3:
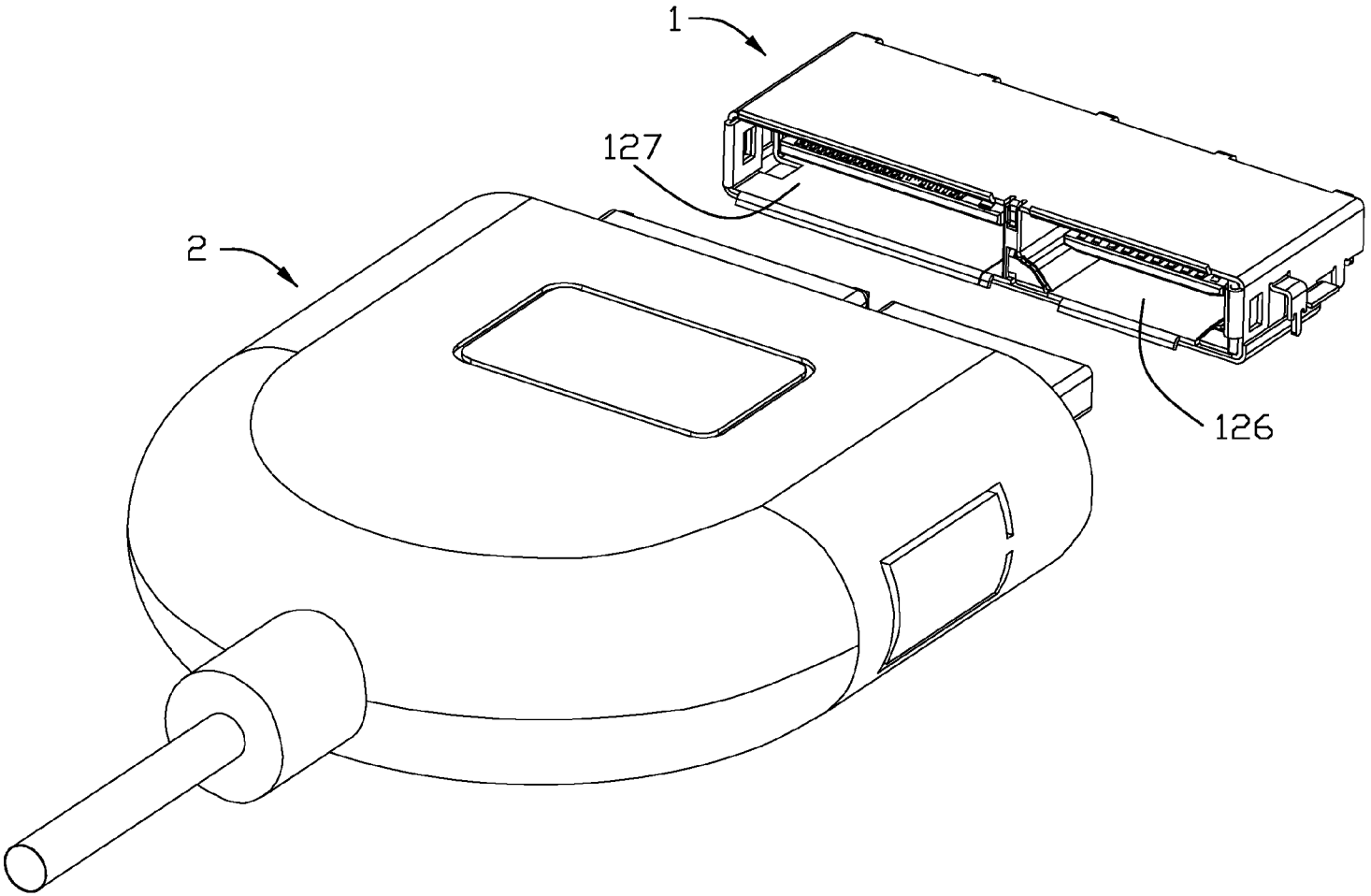
FIG. 3 is an illustration showing the receptacle connector is mating with a cable connector with two different interfaces.

Referring to FIGS. 2 to 3, the receptacle connector 1 includes first and second mating openings 126 and 127 to interconnect with a first cable connector 2 having an HDMI interface 20A and another interface 20B, or alternatively, a second cable connector 3 having an HDMI interface 30.

Figure 4:
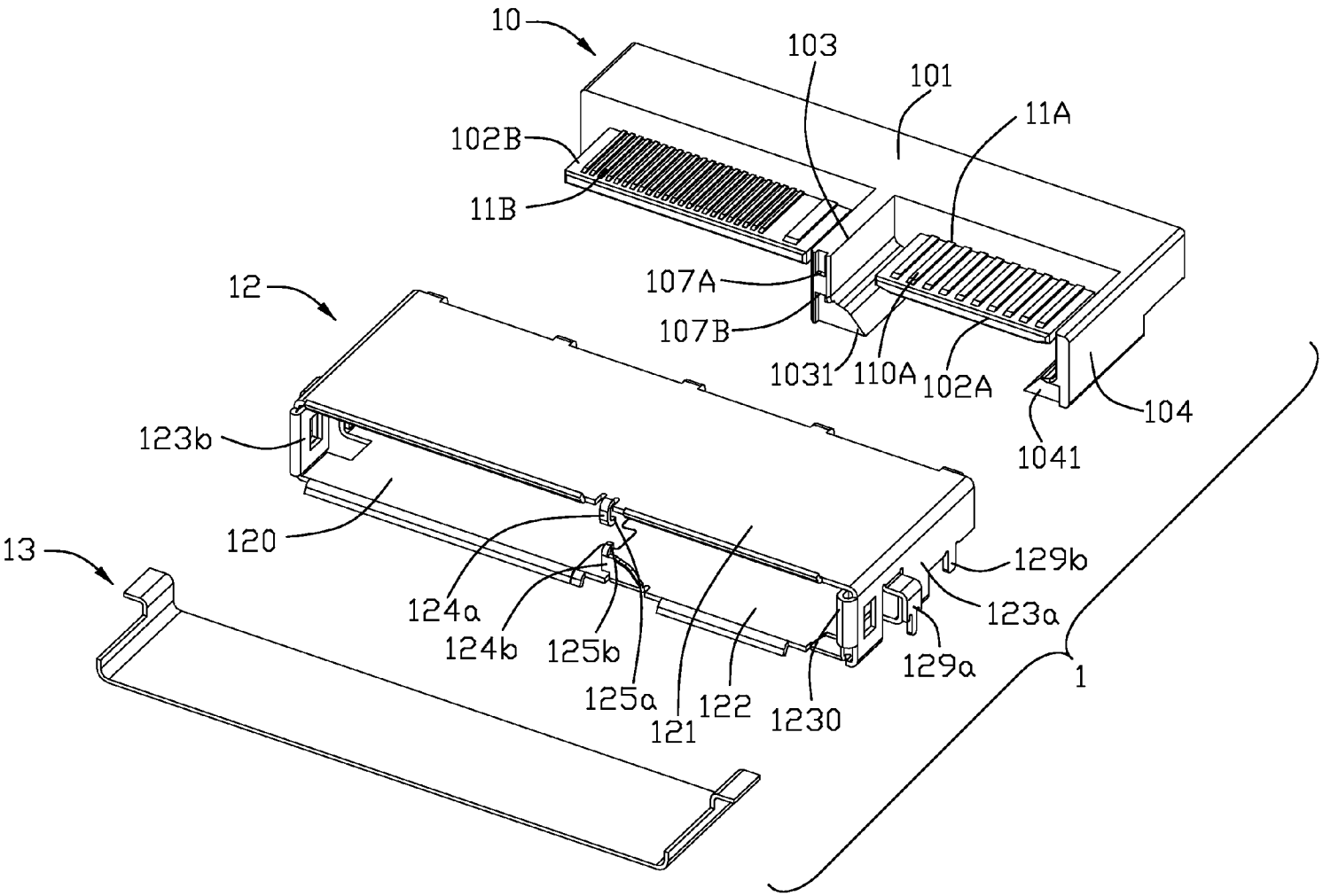
FIG. 4 is an exploded view of the receptacle connector shown in FIG. 1.
Figure 5:
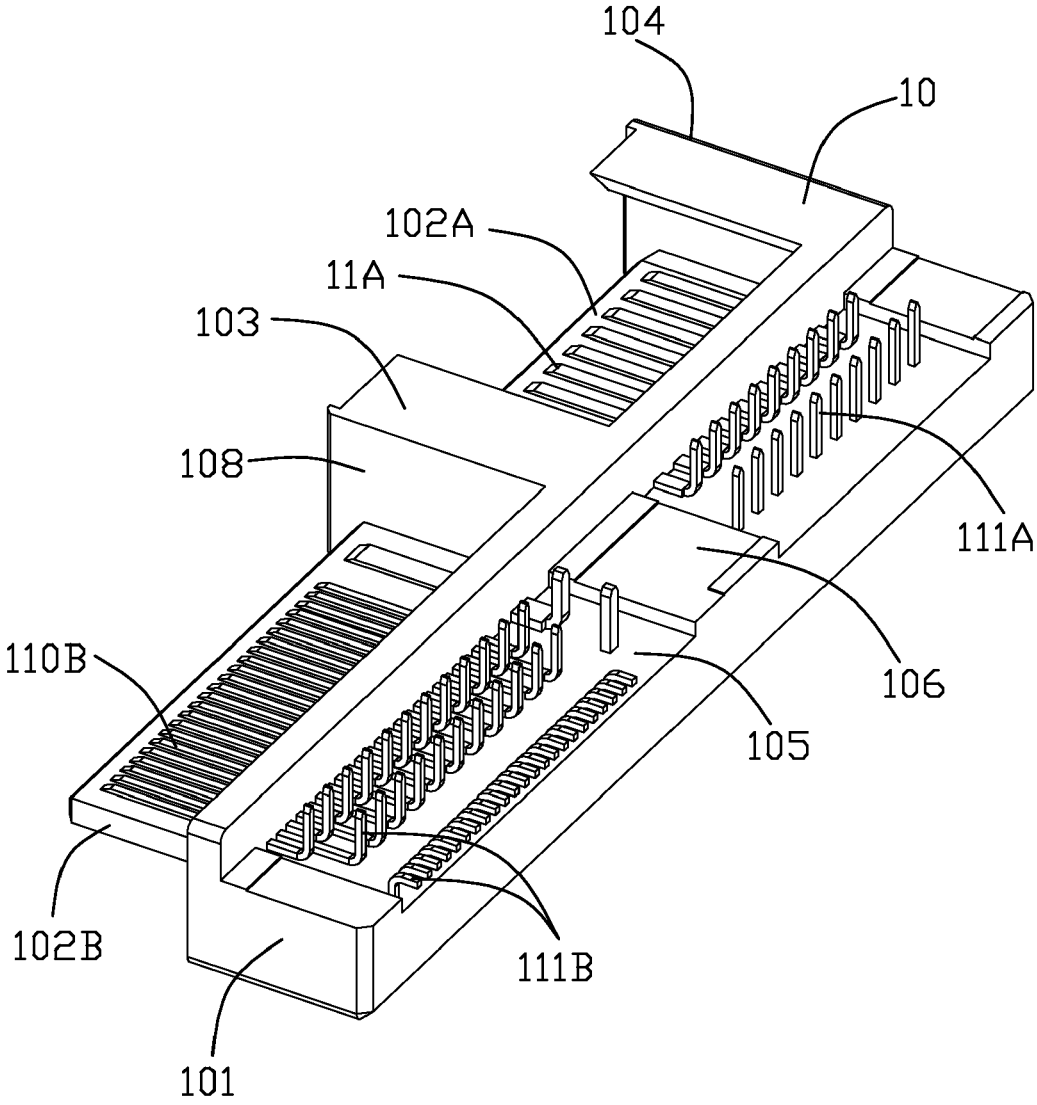
FIG. 5 is a rear and bottom view of the receptacle connector with a shielding shell and reinforced bracket removed therefrom.
Figure 8:
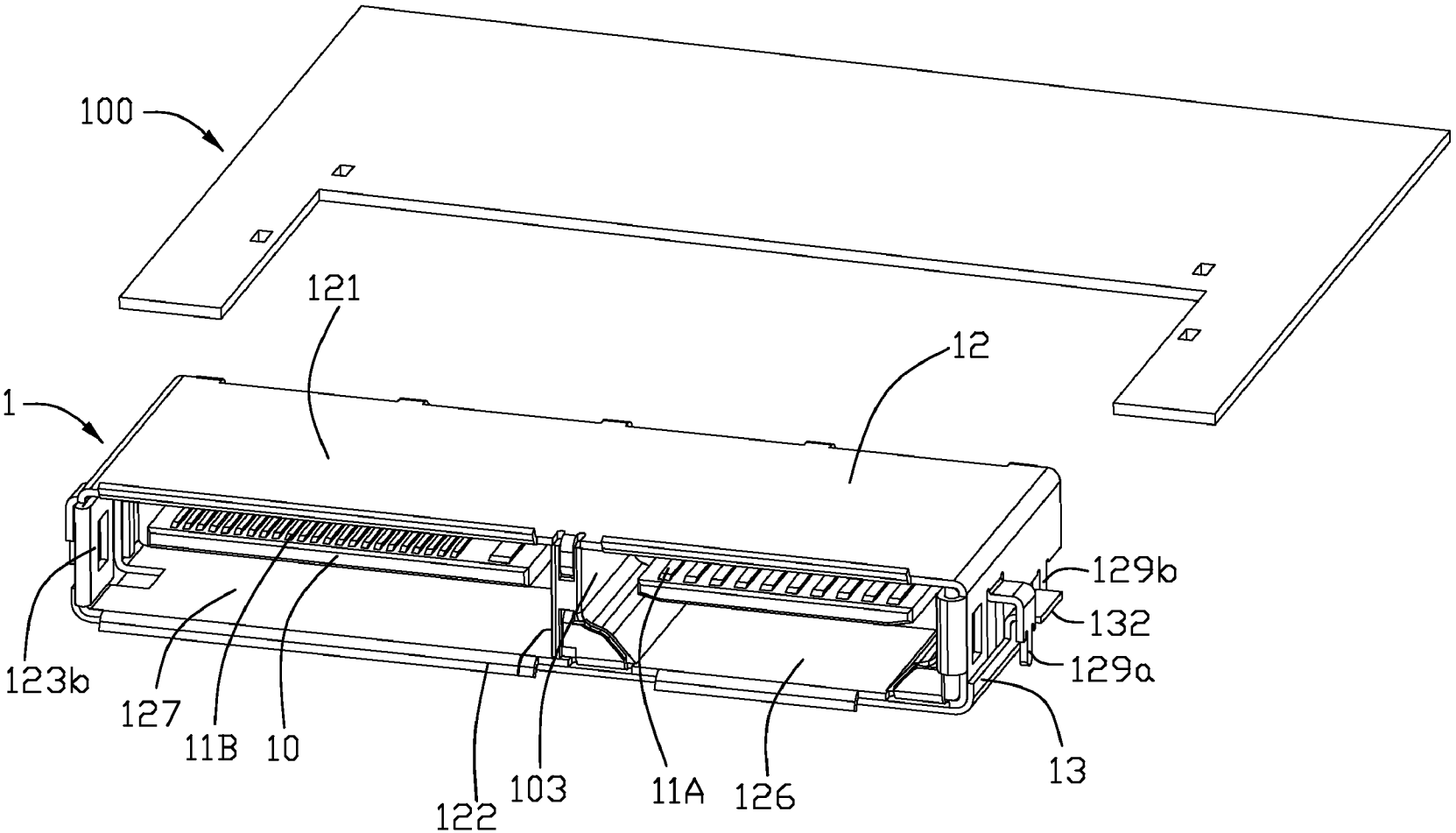
FIG. 8 is a view similar to FIG. 1, and showing the receptacle connector will be mounted on the Printed Circuit Board (PCB)

Referring to FIGS. 1, 4 and 5, the insulative housing 10 is provided with a base portion 101, a first tongue portion 102A, a second tongue portion 102B and a partitioning wall 103 extending forwardly from the base portion 101, respectively. The partitioning wall 103 is located between and perpendicular to the first tongue portions 102A and the second tongue portion 102B, and the partitioning wall provides a robust guiding arrangement when both connectors are mating together. The base portion 101 has a recessed area 105 at bottom thereof, i.e. in a rear area in this embodiment, thereby a mounting surface 106 for mounting onto the PCB 100 (shown in FIG. 10) is higher than a bottom of the base portion 101 so as to reduce the height of the receptacle connector mounted on the PCB. A top faces of both the partitioning wall 103 and the base portion 101 are located at the same level. Each of the tongue portions 102A,102B is provided with the first terminals 11A and the second terminals 11B with different pitch arrangements, respectively, and each of the first and second terminals is formed with retaining portions secured to the base portion 101 of the insulative housing 10, and further includes a contact portion 110A,110B extending forwardly from one end of the retaining portion along a corresponding passageway of the tongue portion 102A,102B and a solder portion 111A,111B extending backward from another end of the retaining portion beyond the mounting surface 106 of the insulative housing 10 for connecting with PCB. The PCB having a cutout at an edge thereof for receiving the receptacle connector (shown in FIG. 8).

Figure 7:
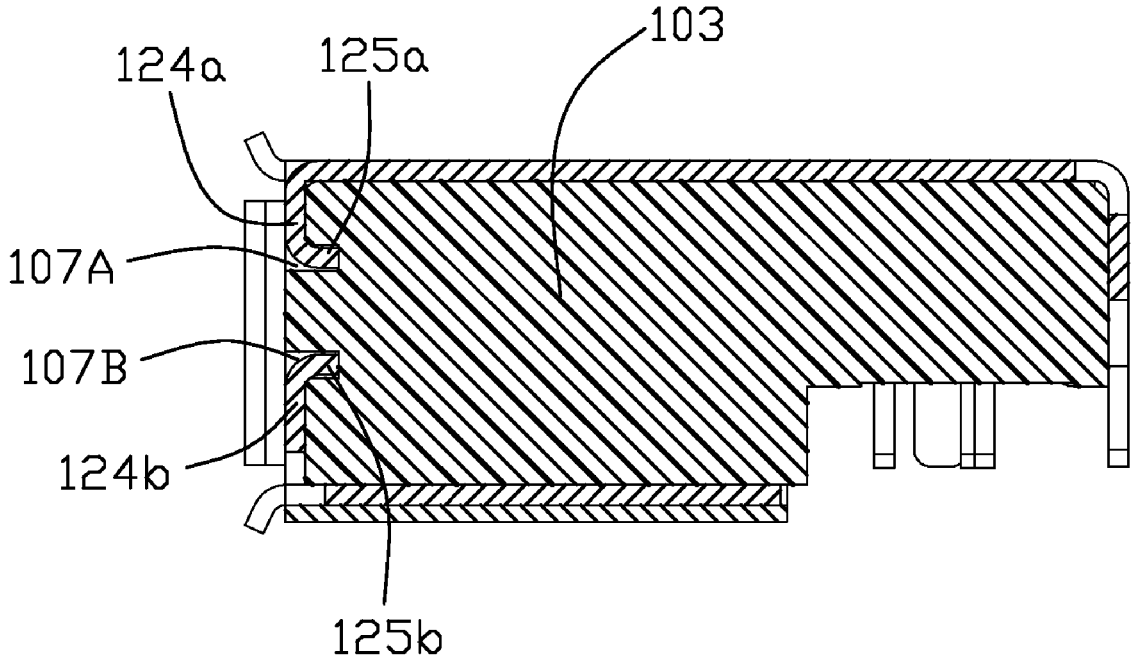
FIG. 7 is a cross-section view taken along a line 7-7 in FIG. 1.

With referring to FIGS. 1, 4 and 7, the shielding shell 12 is assembled on the insulative housing 10 for preventing the receptacle connector from EMI (Electro Magnetic Interference). The shielding shell 12 defines an upper sidewall 121, lower sidewall 122 and a pair of endwalls 123*a*, 123*b* interconnecting with the upper and lower sidewalls 121,122 thereby forming a mating cavity 120 thereamong. Each of the upper sidewall 121 and the lower sidewall 122 is provided with a bent portions 124*a*, 124*b* extending toward each other, respectively, and the partitioning wall 103 defines a pair of holes 107A,107B for receiving hooks 125*a*,125*b* of the bent portion 124*a*,124*b* of the shielding shell 12 so that the upper sidewall 121 and the lower sidewall 122 of the shielding shell 12 can be prevented from being humping up and increase the overall strength of the receptacle connector. And each of the endwalls has a pair of solder tails 129*a*, 129*b* for mounting on the PCB.

Further referring to FIGS. 1, 2 and 5, it is noted that the partitioning wall 103 of the insulative housing 10 extends into the mating cavity 120 from the base portion 101 to partition the mating cavity 120 into two mating openings 126 and 127, and one of the mating opening has a shape different from another. In the embodiment shown in the figures, the mating opening 126 is design to conform to a HDMI (High Definition Multimedia Interface) protocol for connecting with the HDMI interface 30 of the second cable connector 3 or said pair of different interfaces of the second cable connector 2. That is, the popular HDMI interface 3 of the second cable connector 3 can be directly mated with the receptacle connector 1. Alternatively, the receptacle connector 1 can be inserted with the first cable connector having said HDMI interface 20A and another interface 20B. So with this configuration, the receptacle connector can be used efficiently. In preferred embodiment, the mating opening 127 is for a docking station so that the receptacle connector 1 can be used to connect to a docking station to expand different interfaces.

Figure 9:
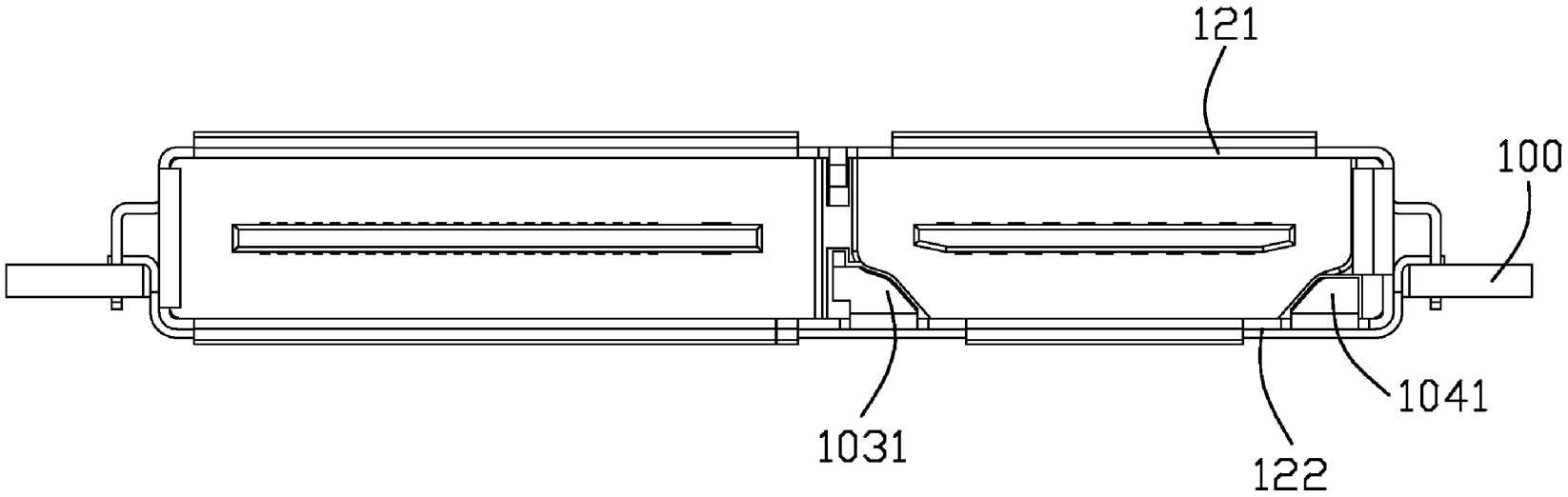
FIG. 9 is a front elevational view of the receptacle connector shown in FIG. 8, with the receptacle connector mounted on the PCB.

The insulative housing further defines an endwall 104 at outmost end of the base portion 101, which is opposite to the partitioning wall 103, and the shielding shell 12 defines a retention wall 1230 extending from a front edge of the endwall 123*a* of the shielding shell 12. The endwall 104 and the partitioning wall 103 each includes a slant portion 1041, 1031 protruding into the mating opening 126 to form said HDMI opening. A first side-face 108 (shown in FIG. 5) opposite to the HDMI opening of the partitioning wall 103 cooperates with the endwall 123*b* of the shell to form said mating opening 127. The upper sidewall 121 and the lower sidewall 122 of the shielding shell 12 serve as an upper side and a lower side of the mating opening 126, 127 respectively, thereby the overall height of the receptacle connector 1 can be made even thinner (shown in FIG. 9). The shielding shell further includes a real panel so as to shield the base portion of the insulative housing 10 (see FIG. 2).

Figure 6:
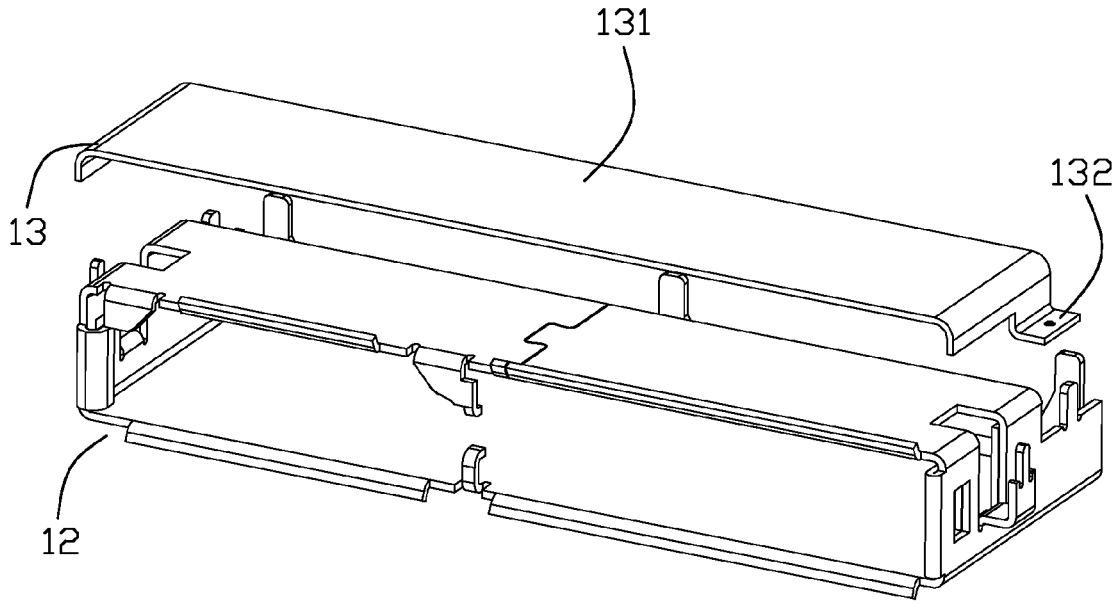
FIG. 6 is a perspective view of the shielding shell and the reinforced bracket viewing from a bottom thereof.
Figure 10:
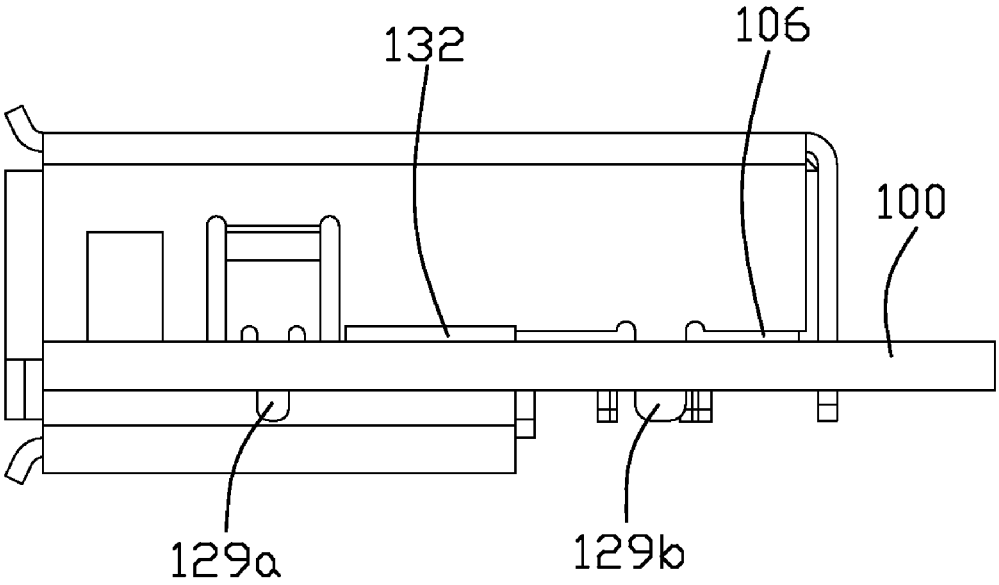
FIG. 10 is a side view of the receptacle connector with the PCB shown in FIG. 9.

With referring to FIGS. 6 and 10, the reinforced bracket 13 attached to a bottom of the shielding shell 12 by spot soldering so as to provide a steady engagement therebetween. The reinforced bracket 13 has a main portion 131 attached to the bottom of the shielding shell 12 and a pair of mounting portions 132 extending from two ends of the main portion 131 for mounting onto the PCB, therefore, said structure would improve the strength of the mating cavity 120 of the receptacle connector 1, and there is a satisfactory coplanarity between the mounting portion 132 of the reinforced bracket 13 and the mounting surface 106 of the insulative housing 10 so that all of them can be reliably mounted to the PCB, and the mounting portion 132 is located between the solder tails 129*a*, 129*b*.

Figure 11:
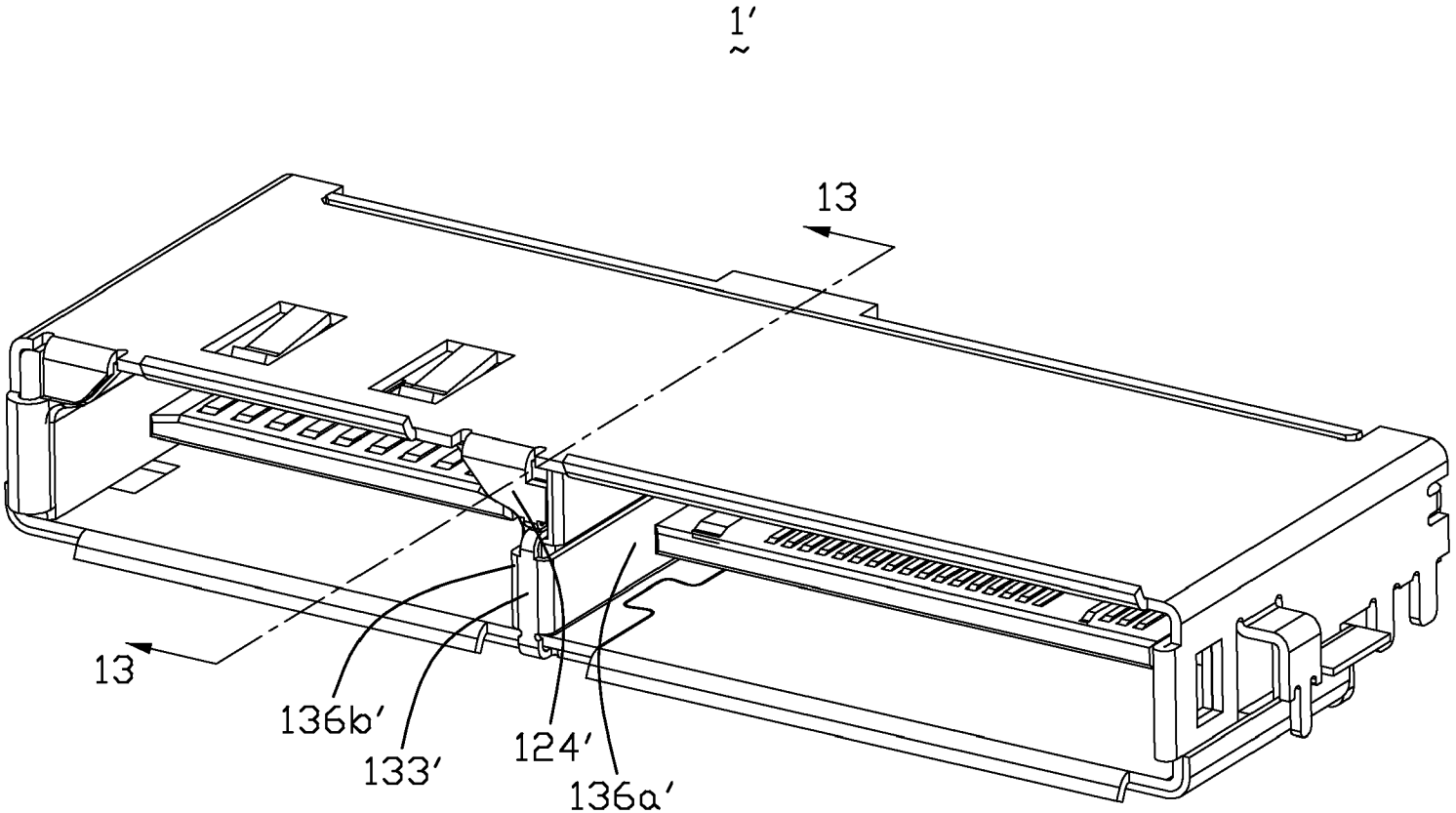
FIG. 11 is a perspective view of a receptacle connector in accordance with a second embodiment of the present invention.
Figure 12:
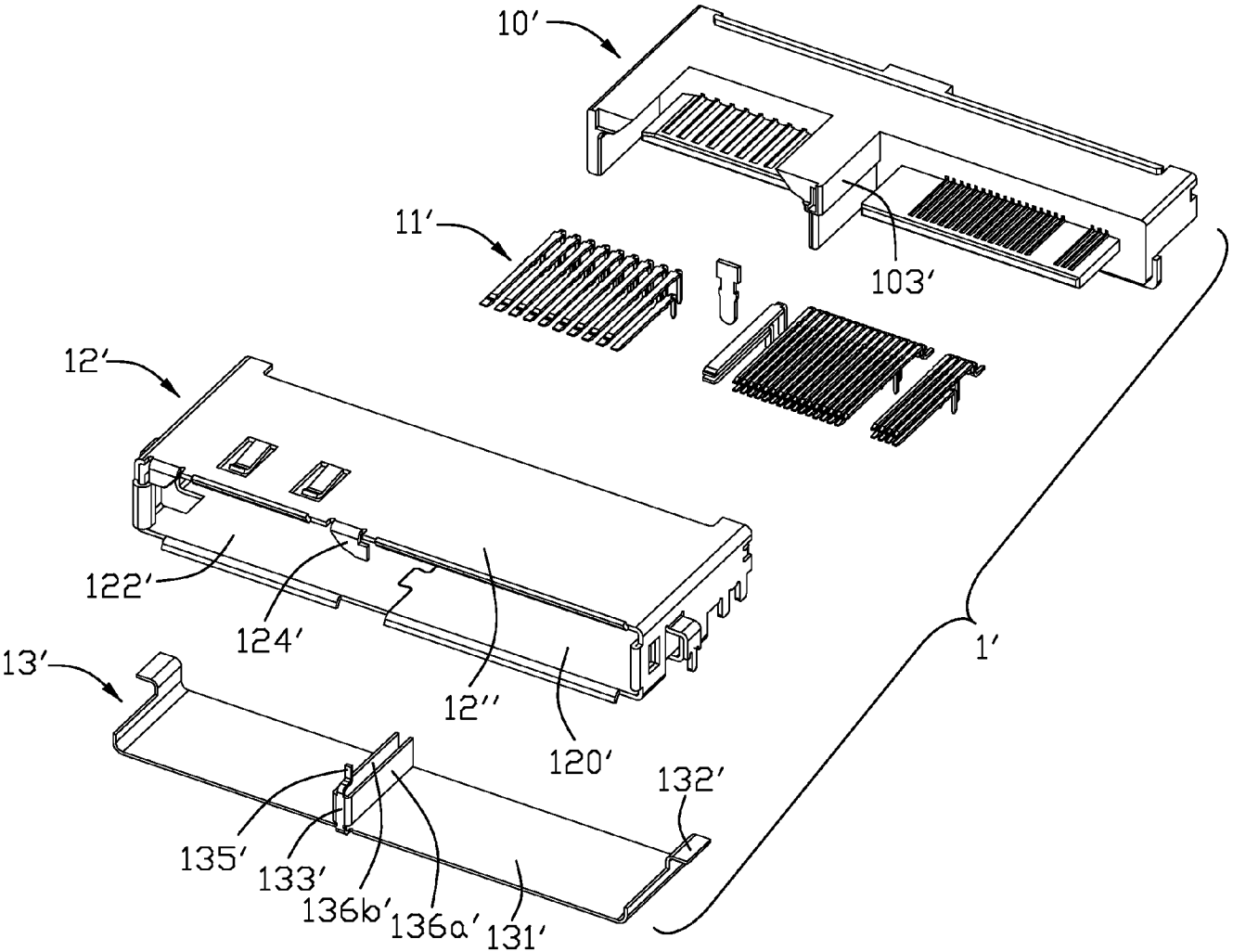
FIG. 12 is an exploded view of the receptacle connector shown in FIG. 11.
Figure 13:
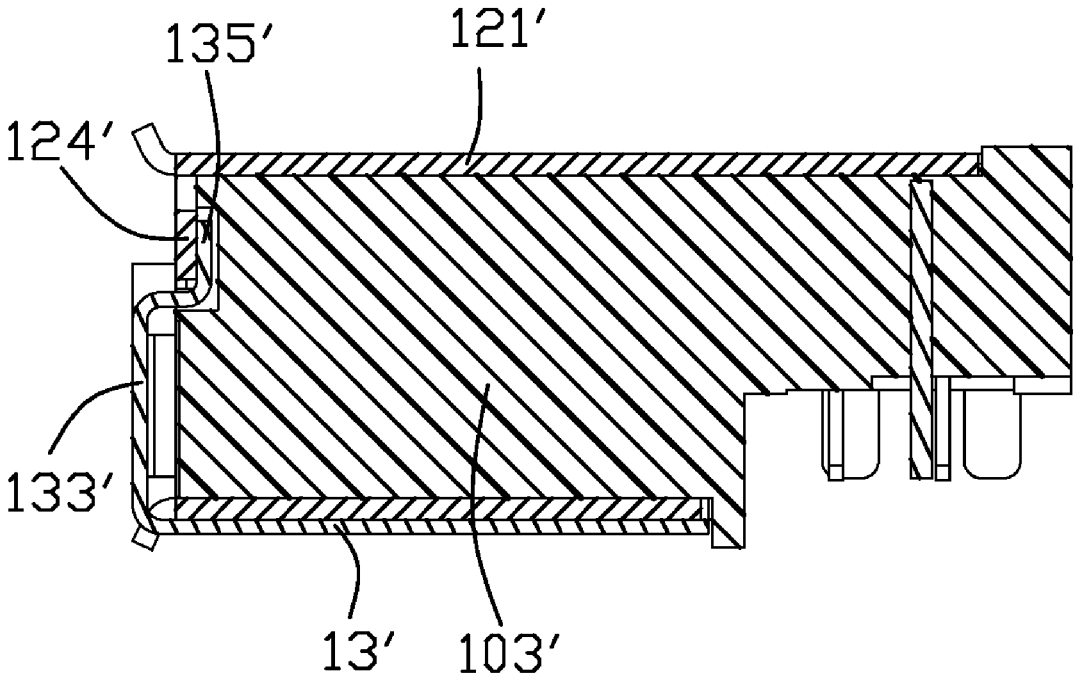
FIG. 13 is a cross-section view taken along a line 13-13 in FIG. 11.

Referring FIGS. 11 to 13, a receptacle connector 1' of a second embodiment of the present invention is shown, and shows a modification of the receptacle connector 1 illustrated in FIG. 1. The receptacle connector 1' comprises an insulative housing 10', a plurality of terminals 11', a shielding shell 12' and a reinforced bracket 13', similar to the above first embodiment except the shielding shell 12' and the reinforced bracket 13'.

The shielding shell 12' defines an upper sidewall 121' with a second bent portion 124' extending from a front edge thereof and a lower sidewall 122' and formed a mating cavity 120' therebetween, the reinforced bracket 13' comprises a main portion 131' attached to a bottom of the shielding shell 12' and a pair of mounting portions 132' extending from two ends thereof for mounting onto the PCB, and the reinforced bracket 13' further defines a first bent portion 133' extending toward an partitioning wall 103' of the insulative housing 10' from a front edge thereof, and an end portion 135' of the first bent portion 133' is located inside of the second bent portion and retained therebetween by spot soldering. And the bent portion 133' of the reinforced bracket 13' defines a pair of protect walls 136*a*', 136*b*' abut against opposite sides of the partitioning wall 103' to increase strength of the partitioning wall of the receptacle connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. A receptacle connector comprising:

an insulative housing having a base portion;

a plurality of terminals retained in the insulative housing;

a shielding shell assembled on the base portion of the insulative housing and defined a mating cavity; and a reinforced bracket including a main portion attached to a bottom of the shielding shell and a pair of mounting portions extending toward opposite directions from two ends of the main portion, and the mating cavity of the shielding shell sandwiched between the pair of mounting portions; wherein the insulative housing has a partitioning wall extending into the mating cavity from a base portion of the insulative housing to partition the mating cavity into a pair of mating openings, and the reinforced bracket has a first bent portion with a pair of protect walls abutting against opposite sides of the partitioning wall.

2. The receptacle connector as described in claim 1, wherein the base portion defines a mounting surface with a recessed area defined thereon to provide coplanarity between the mounting portion of the reinforced bracket and the mounting surface of the insulative housing.

3. The receptacle connector as described in claim 2, wherein the insulative housing defines tongue portion extending into the mating cavity from the base portion, each the terminal has a contact portion extending forward for retaining a passageway of the tongue portion and a soldering portion extending backward and beyond the mounting surface of the insulative housing.

4. The receptacle connector as described in claim 1, wherein the shielding shell includes an upper sidewall has a second bent portion bent extending toward the first bent portion of the reinforced bracket, and the first bent portion and the second portion are retaining by spot soldering.

5. An electrical connector assembly comprising:

a printed circuit board having a cutout at an edge thereof;

a receptacle connector received the cutout of the printed circuit board, and comprising:

an insulative housing;

a plurality of terminals retained in the insulative housing;

a shielding shell covering the insulative housing and defined a mating cavity; and a reinforced bracket including a main portion attached to a bottom of the mating cavity of the shielding shell and a pair of mounting portions extending from two ends of the main portion for mounting onto the printed circuit board; wherein the mating cavity of the shielding shell defines an upper sidewall, lower sidewall and a pair of endwalls interconnecting with the upper and lower sidewalls thereby forming said mating cavity thereamong, and each the endwall of the shielding shell has a solder tail abutting the mounting portion of the reinforced bracket.

6. The electrical connector assembly as described in claim 5, wherein the insulative housing includes a base portion and a partitioning wall extending into the mating cavity from the base portion to partition the mating cavity into two mating openings, and the reinforced bracket has a first bent portion with a pair of protect walls abutting against opposite sides of the partitioning wall.

7. The electrical connector assembly as described in claim 6, wherein the shielding shell having an upper sidewall with a second bent portion bent extending toward the first bent portion of the reinforced bracket, and the first bent portion and the second portion are retaining by spot soldering.

8. An electrical connector assembly comprising:

a printed circuit board defining a cutout at an edge thereof;

a metallic reinforced bracket spanned over the cutout with a bottom surface lower than a bottom surface of the printed circuit board; and a shielded connector disposed onto the reinforced bracket and having tails interconnected to the printed circuit board; wherein the reinforced bracket includes at least one mounting portion to be seated upon an upper surface of the printed circuit board around said cutout to retain the reinforced bracket unto the printed circuit board; wherein the connector defines a mating cavity, and the bracket defines a protecting wall extending into the mating cavity.

9. The electrical connector assembly as described in claim 8, wherein the connector includes an insulative housing to define the mating cavity, and said housing defines a partition wall against which said protecting wall is adapted to abut.

10. The electrical connector assembly as described in claim 8, wherein said shielded connector includes a metallic shell defining a lower side wall and a pair of end walls, and said bracket defines a U-shaped main portion enclosing the lower side wall and lower portions of said pair of end walls.

* * * * *